United States Patent [19]

McConnell et al.

[11] 4,440,998

[45] Apr. 3, 1984

[54] SEGMENTED CIRCUIT BREAKER HOUSING WITH ROTATABLY ADJUSTABLE BUSHING POSITIONS

[75] Inventors: Lorne D. McConnell; Edward M. Spencer, both of Chalfont, Pa.

[73] Assignee: Brown Boveri Electric Inc., Rolling Meadows, Ill.

[21] Appl. No.: 396,776

[22] Filed: Jul. 9, 1982

[51] Int. Cl.[3] ..... H01H 33/70

[52] U.S. Cl. ..... 200/148 R; 174/161 R; 361/335

[58] Field of Search ..... 174/18, 161 R; 361/335; 200/148 R, 144 R, 148 B, 339, 340, 333

[56] References Cited

U.S. PATENT DOCUMENTS

| | | | |
|---|---|---|---|
| 3,857,006 | 12/1974 | Daimon et al. | 200/148 R X |
| 3,864,534 | 2/1975 | Goodwin, Jr. et al. | 200/148 B X |
| 4,016,382 | 4/1977 | Roth | 174/18 |

FOREIGN PATENT DOCUMENTS

| | | | |
|---|---|---|---|
| 762804 | 1/1953 | Fed. Rep. of Germany | 174/161 R |

*Primary Examiner*—E. A. Goldberg
*Assistant Examiner*—Morris Ginsburg
*Attorney, Agent, or Firm*—Ostrolenk, Faber, Gerb & Soffen

[57] ABSTRACT

A multi-pole circuit breaker has interrupters contained in respective housing sections which have two bushings extending perpendicularly from either end of the housing section. Each housing section is segmented at its center so that the two halves which are defined can rotate relative to one another whereby the bushings extending from the housing halves can have different angular relationships with respect to one another and the bushing-free ends can have different spacings. The circuit breaker can be used as an indoor or outdoor circuit breaker with common parts but the bushing spacing is altered by adjusting the angular relationship of the bushings relative to one another.

10 Claims, 6 Drawing Figures

SEGMENTED CIRCUIT BREAKER HOUSING WITH ROTATABLY ADJUSTABLE BUSHING POSITIONS

BACKGROUND OF THE INVENTION

This invention relates to circuit breaker housings and more particularly relates to a novel circuit breaker housing which is segmented, with each segment carrying a respective bushing which can be fixed in any desired adjustable angular relationship with respect to the other bushing.

Circuit breakers of the same rating are used in both metal-clad switchgear installations or in outdoor substations as free-standing circuit breakers. Thus, a circuit breaker having a 15 kV nominal service voltage can use a given basic interrupter structure and operating mechanism but requires many different interrupter housing parts, depending on whether it is for metal-clad switchgear or for an outdoor free-standing circuit breaker application.

For example, in a metal-clad draw-out switchgear application of well-known variety, the pole spacing for a 15 kV nominal service voltage would be about 10 inches center to center between the parallel axes of the bushings of adjacent poles of the circuit breaker. This spacing is adequate to provide space for current transformers and for insulated plug-in entrance bushings of conventional type. The vertical spacing between the bushings of each pole can be of the order of 12 inches, although this is determined by the interrupter size. For an outdoor free-standing circuit breaker application, however, where insulated plug-in bushings are not employed, it is necessary to provide a relatively large air-insulated line-of-sight gap between the terminals at the free ends of the bushings. This requires a spacing, bushing to bushing, greater than about 15 inches both vertically and horizontally.

Because of these different requirements for bushing separation, for metal-clad switchgear application or free-standing outdoor application, the following complexities arise:

(a) The different circuit breakers must employ different single-pole housing sizes.

(b) The different circuit breakers must employ different manifold lengths.

(c) The circuit breakers employ jackshafts from the operating mechanisms of different lengths.

(d) The two different breaker forms have different gas volumes wherein the gas volume for the outdoor breaker is larger than for the metal-clad switchgear.

A principal object of this invention is to effect substantial economy in manufacturing and inventory costs, by providing an arrangement for a circuit breaker housing in which the same basic interrupter housing section is used for either a metal-clad application or a free-standing substation application.

BRIEF DESCRIPTION OF THE INVENTION

In accordance with the present invention, the circuit breaker housing which contains the interrupters and from which the circuit breaker bushings extend is segmented at a point approximately halfway between the bushings for each phase of the circuit breaker. The housing is preferably segmented by cutting through the housing perpendicularly to its axis. The pair of bushings for the pole are fixed to respective housing halves, and are then rotatable with respect to one another by rotating the housing halves. The bushing axes can be fixed at one of two or more possible angular relationships with respect to one another. In this way, the free ends of the bushings can be spaced as needed for the application of the circuit breaker.

For example, if the circuit breaker is to be employed as a draw-out unit in metal-clad switchgear, the housing halves of each phase are rotated so that the bushings for each housing half of each pole have parallel axes and extend from the housing in the same direction. The bushings can then be plugged in and out of cooperating disconnect contacts carried on the switchgear. If, however, the same breaker is to be employed as a free-standing outdoor circuit breaker, the housing halves are rotated relative to one another to a different fixed angular relationship so that the bushing ends are not aligned and are more widely spaced than when the bushing axes are parallel and extend in the same direction from the housing. Thus, in the outdoor application, the terminal-to-terminal clearance across poles can be increased well beyond the necessary gap required for outdoor application without any other change in the housing components. The flanged joint, or any other desired connection arrangement between the segmented housing sections, will be capable of connection in one of two or more different angular positions relative to one another. Thus, bushings may be fixed relative to one another with parallel bushing axes which extend in the same direction from the housing; with the bushing axes rotated 180° relative to one another to extend from the housing in opposite directions; or the bushing axes may be at an angle less than 180°, such as 135°. In the latter arrangement, the bushings of the outer pairs of poles of an outdoor three-pole circuit breaker would then have suitable clearance from one another and from the free ends of the bushings of the center pole.

DETAILED DESCRIPTION OF THE DRAWINGS

Figure 2:
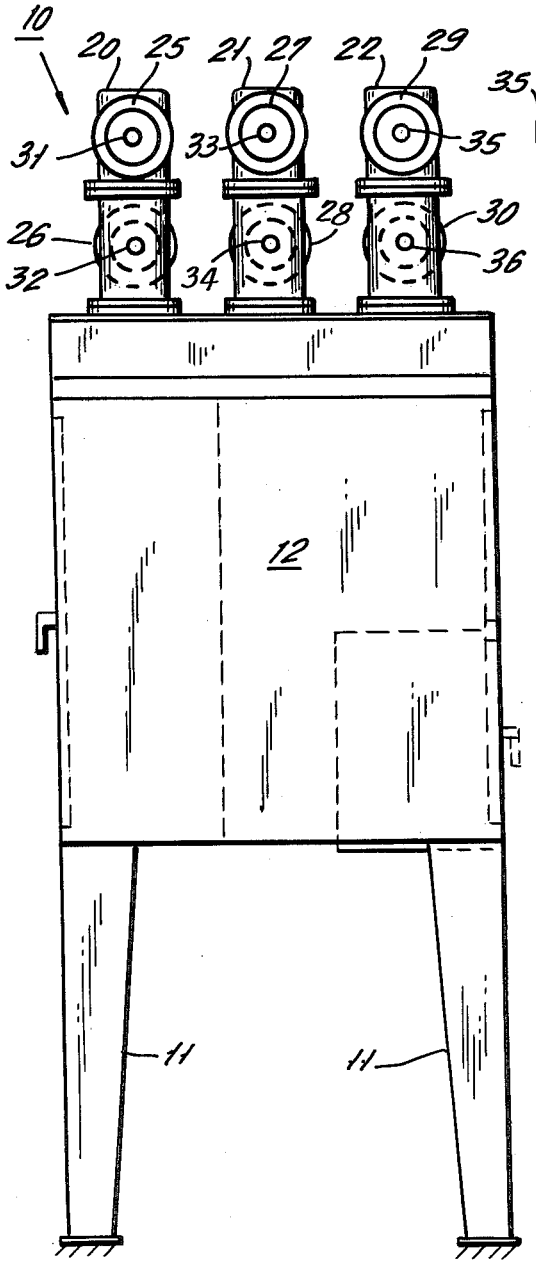
FIG. 2 is an elevation view of an outdoor free-standing circuit breaker which employs housings of the kind shown in FIG. 1.
Figure 3:
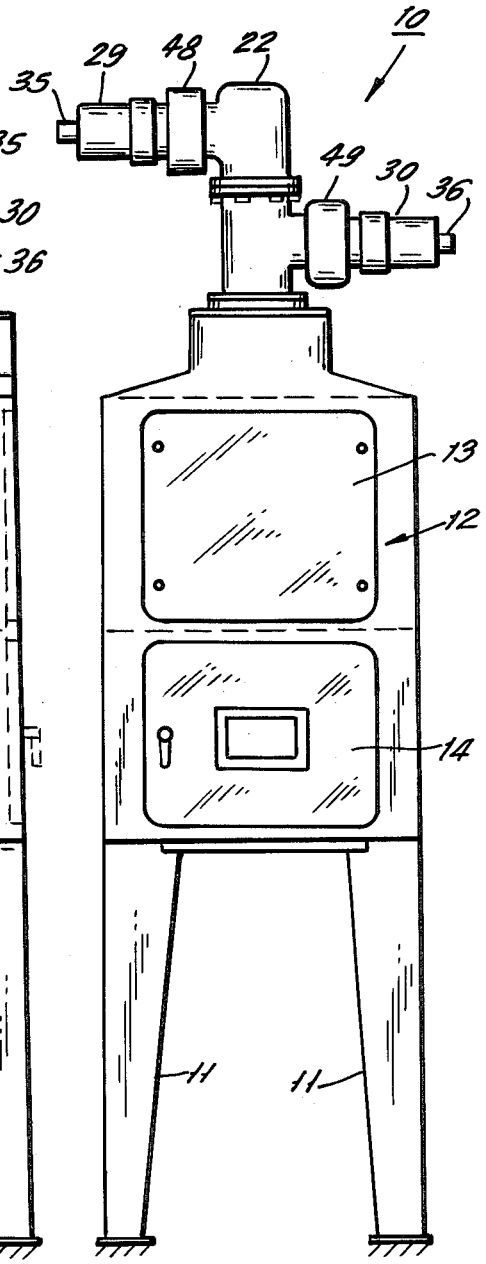
FIG. 3 is a side view of the circuit breaker of FIG. 1.

Referring first to FIGS. 2 and 3, there is shown therein a first embodiment of the invention as applied to a free-standing circuit breaker 10. The free-standing circuit breaker 10 is of conventional outline and employs removable support legs 11 which carry an operating mechanism compartment 12. Compartment 12 can have, as shown in FIG. 3, openable doors 13 and 14 which provide access to the interior of the mechanical operating mechanism and to the monitoring relays for the circuit breaker and the like.

Fixed atop the housing 12 are tubular metal interrupter housings 20, 21 and 22 which all contain respective conventional circuit interrupters. The circuit interrupters may be sulfur hexafluoride type of interrupters. Housing 22 is shown in more detail in FIG. 1 which will later be discussed.

Housings 20, 21 and 22 are identical in construction and have pairs of bushings 25–26, 27–28 and 29–30, respectively extending therefrom. Bushings 25–30 are of conventional construction and have central conductors extending therethrough shown as conductors 31–36 for bushings 25–30, respectively. These bushing conductors terminate at the free end of each of bushings 25–30. The opposite end of each of the conductors 31–36 is internally connected to the respective interrupter within the housings 20, 21 and 22. Each of the bushings is then associated with a suitable current transformer, such as the current transformers 48 and 49, shown in FIG. 3 as surrounding bushings 29 and 30, respectively.

Figure 1:
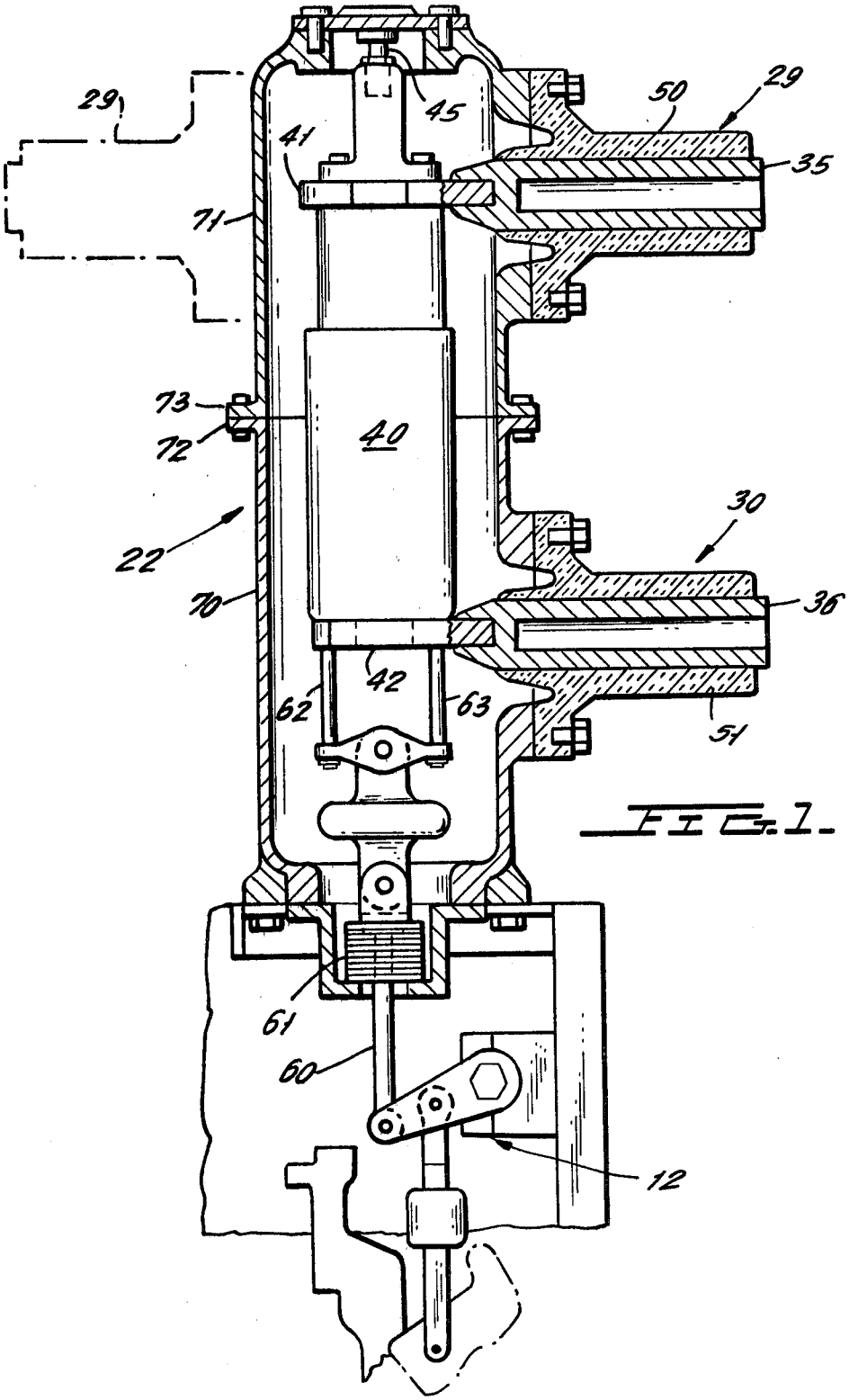
FIG. 1 is a cross-sectional view taken through the housing of a single pole of a circuit breaker employing a split housing in accordance with the present invention.

FIG. 1 shows the pole 22 which contains an interior interrupter structure 40 of any desired type. Interrupter 40 is terminated by first and second conductive terminals 41 and 42 which are connected to the interior ends of bushing conductors 35 and 36, respectively. As further shown in FIG. 1, the interrupter 40 is fixed within the housing 22 as by a suitable connection 45 to the upper end of housing 22 and by support from the ends of bushing conductors 35 and 36. The bushing conductors 35 and 36 are, in turn, supported within insulation housings 50 and 51, respectively, which are appropriately bolted to identical openings in the wall of housing 22.

In order to operate the interrupter 40, an operating mechanism 12 is provided which has an output shaft 60 connected through bellows 61 to operating rods 62 and 63 which are connected to the cooperating contacts (not shown) within interrupter 40 which operate in a conventional manner. Note that the entire housing section 22 is hermetically sealed and can be filled with sulfur hexafluoride gas under a slight positive pressure.

In accordance with the present invention, the housing 22, as well as housings 20 and 21 of FIGS. 2 and 3, is formed of two coaxial housing halves 70 and 71 which terminate in flanges 72 and 73, respectively. Flanges 72 and 73 may be bolted together in sealed arrangement by any suitable bolt arrangement. By employing an at least partly symmetrical form for the bolt arrangement for flanges 72 and 73, the housing sections 70 and 71 can be connected to one another in at least two different angular configurations.

As shown in FIG. 1, housing halves 70 and 71 are fixed to one another at flanges 72 and 73, so that the axes of bushings 29 and 30 are parallel to one another and both extend from the same side of the housing 22. By employing this configuration for each of the poles of a multi-pole circuit breaker, the circuit breaker can be employed as a draw-out circuit breaker for metal-clad switchgear. In this arrangement, the corresponding bushings of each of the poles are in line with one another. However, the novel invention permits housing 71 to be fixed relative to housing 70 so that the bushing 29 is in the dotted line position shown in FIG. 1, which is rotated 180° relative to bushing 30. This is the configuration of the bushing pairs of FIGS. 2 and 3 which is employed for application of the circuit breaker as a free-standing, air-insulated circuit breaker for an outdoor substation.

The free-standing circuit breaker of FIGS. 2 and 3 is nominally rated at 15.5 kV and employs a pole-to-pole spacing of greater than about 15 inches. The vertical spacing between the bushings of each pole is 12 inches. Note that the rotation of the housing halves increases the spacing of the free ends of the bushings of each pole from 12 inches to approximately 44 inches.

From the foregoing, it will be seen that essentially the same basic housing for the circuit breaker housing can be employed, whether the breaker is employed in metal-clad indoor switchgear in the form shown, for example, in FIG. 1, or in a free-standing, air-insulated circuit breaker with the bushings rotated relative to one another to the positions shown in FIGS. 2 and 3.

Figure 4:
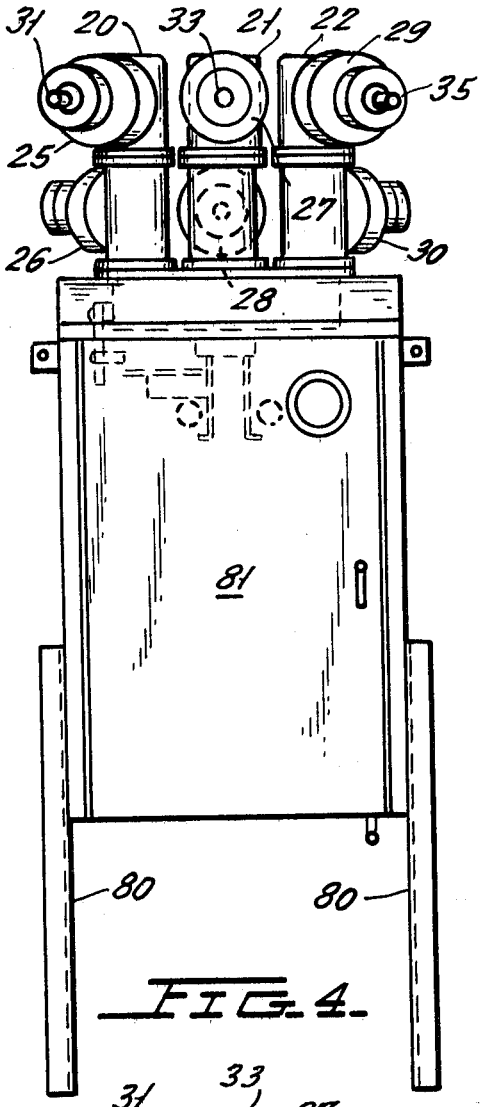
FIG. 4 is an elevation view of a circuit breaker of a second embodiment of the present invention in free-standing form.
Figure 5:
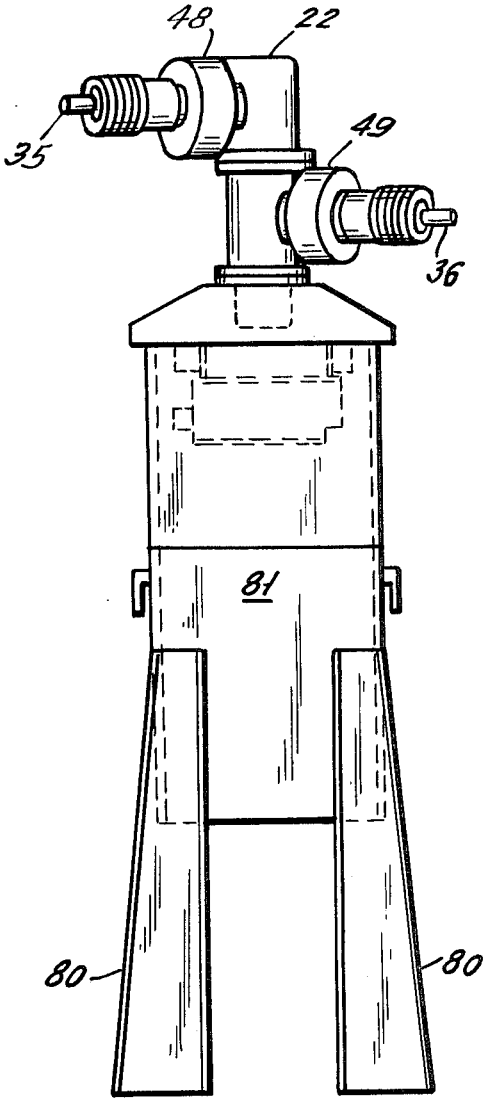
FIG. 5 is a side view of the circuit breaker of FIG. 4.
Figure 6:
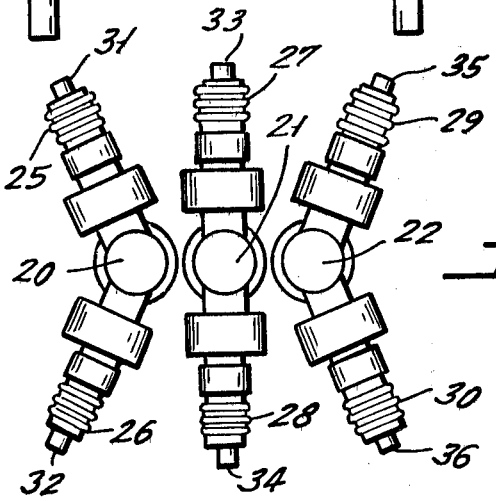
FIG. 6 is a plan view of the circuit breaker of FIGS. 4 and 5.

FIGS. 4, 5 and 6 show a second embodiment of the present invention for application to a free-standing air-insulated circuit breaker. Thus, in FIGS. 4, 5 and 6, the circuit breaker employs suitable support legs 80 and control and support cabinet 81. The interrupter housings 20, 21 and 22 have a structure which can be identical to that described in FIGS. 1, 2 and 3. However, the bushings in FIGS. 4, 5 and 6, which have identical numerals to those of FIGS. 1, 2 and 3, have a slightly different configuration since they employ skirted insulators.

The principal difference between the free-standing circuit breaker of FIGS. 4, 5 and 6 and the preceding figures is that the bushing pairs of the two outer poles 25–26 and 29–30 are rotated about 135° relative to one another while bushings 27 and 28 are in line with one another. Clearly, this different configuration of the bushings relative to one another is easily achieved, employing identical hardware by simply fixing the segmented housings 20, 21 and 22 at suitable angles relative to one another.

The circuit breaker of FIGS. 4, 5 and 6 may also be a 15.5 kV circuit breaker, but employs a center-to-center spacing for housings 20, 21 and 22 of 10 inches. The free ends of the two outer poles of FIG. 6 are spaced from one another by approximately 40.6 inches, while the bushing end spacing between the bushings of the outer pole and center pole is approximately 18.4 inches. Consequently, the design parameter of a line-of-sight spacing between the bushing ends greater than 15 inches is easily obtained without employing different major hardware components.

While the novel invention has been described in connection with a 15 to 15.5 kV circuit breaker, it will be apparent to those skilled in the art that different dimensions could be employed for different ratings.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A circuit breaker housing containing interrupter structure means in which the major parts thereof can be arranged to provide at least two different spacings between free ends of its bushings, whereby said circuit breaker housing can be used in either an indoor or an outdoor application; said circuit breaker housing comprising an elongated cylinder which includes first and second cylinder halves which are coaxial with one another and which both have a respective symmetric flange at one of their respective ends; said flanges having means so that they can be moved relative to each other and being connectable in sealed abutting engagement with one another and being fixed to one another in one of at least two predetermined relative angular relationships; said circuit breaker housing being operable in an installation when said flanges are in either of said at least two angular relationships; each of said first and second cylinder halves having respective cylindrical bushings extending therefrom which have axes which are perpendicular to the axis of said first and second cylinder halves, respectively; each of said bushings of said first and second cylinder halves having a respective free terminal end; said interrupter structure means disposed within the interior of said first and second cylinder halves; said interrupter structure means having first and second terminals connected to said bushings of said first and second cylinder halves, respectively; said free ends of said bushings having a first spacing when the first and second flanges are fixed together in a first of said predetermined angular relationships and having a second spacing when said first and second flanges are fixed together in a second of said predetermined angular relationships.

2. The circuit breaker housing of claim 1, wherein said first and second angular relationships are 180° displaced from one another.

3. The circuit breaker housing of claim 1, wherein said axes of said bushings are in a common plane when said first and second flanges are in at least one of said first or second angular relationships.

4. The circuit breaker housing of claim 3, wherein said first and second angular relationships are 180° displaced from one another.

5. The circuit breaker housing of claim 1, wherein the axes of said bushings are at an angle of less than 180° when said first and second flanges are in at least one of said first or second angular relationships.

6. The device of claim 1, wherein the spacing between said free ends of said bushings is approximately 10 inches and greater than 15 inches when said first and second flanges are in said first and second angular relationships, respectively.

7. A multi-pole circuit breaker; each of the poles of said multi-pole circuit breaker having a respective housing in which the major parts thereof can be arranged to provide at least two different but fully operable spacings between the free ends of its bushings, whereby said circuit breaker can be used in either an indoor or an outdoor application; each of said circuit breaker housings comprising an elongated cylinder which includes first and second cylinder halves which are coaxial with one another and which both have a respective symmetric flange at one of their respective ends; said flanges having means so that they can be moved relative to each other and being connectable in sealed abutting engagement with one another and being fixed to one another in one of at least two predetermined relative angular relationships; each of said first and second cylinder halves having respective cylindrical bushings extending therefrom which have axes which are perpendicular to the axis of said first and second cylinder halves, respectively; each of said bushings of said first and second cylinder halves having a respective free terminal end; interrupter structure means disposed within the interior of said first and second cylinder halves; said interrupter structure means having first and second terminals connected to said bushings of said first and second cylinder halves, respectively; said free ends of said bushings having a first spacing when the first and second flanges are fixed together in a first of said predetermined angular relationships and having a second spacing when said first and second flanges are fixed together in a second of said predetermined angular relationships; each of the bushings extending from at least one of said first and second cylinder halves for each of said poles having axes disposed in respective common planes.

8. The circuit breaker of claim 7, wherein said first and second angular relationships are 180° displaced from one another for each of said housings.

9. The circuit breaker housing of claim 7, wherein said axes of said bushings are in a parallel plane when said first and second flanges are in at least one of said first or second angular relationships for each of said housings.

10. The circuit breaker of claim 7, wherein said poles are spaced from one another along a line in a plane and wherein the axes of said bushings of two poles at the ends of said line of poles are at an angle less than 180° when said first and second flanges of their respective housings are in said first angular relationship.

* * * * *